US008944282B2

(12) United States Patent
Kroupa et al.

(10) Patent No.: US 8,944,282 B2
(45) Date of Patent: Feb. 3, 2015

(54) COMBINATION CONTAINER AND INTEGRAL ATTACHMENT DEVICE

(76) Inventors: Robert Kroupa, Chicago, IL (US); Jeff Grossman, Lake Bluff, IL (US)

( * ) Notice: Subject to any disclaimer, the term of this patent is extended or adjusted under 35 U.S.C. 154(b) by 0 days.

(21) Appl. No.: 11/684,414

(22) Filed: Mar. 9, 2007

(65) Prior Publication Data

US 2008/0230556 A1 Sep. 25, 2008

(51) Int. Cl.
*B67B 7/62* (2006.01)
*B65D 83/04* (2006.01)
*B65D 25/22* (2006.01)

(52) U.S. Cl.
CPC ..... *B65D 83/0409* (2013.01); *B65D 25/22* (2013.01)
USPC ..... 221/185; 221/256; 221/288; 221/263; 221/154

(58) Field of Classification Search
USPC ..... 221/1–312 C, 256, 185, 283, 288, 265, 221/266, 199, 255, 263, 282, 154; 206/38, 206/537; 224/197, 271, 272, 196, 665–666, 224/668, 671, 675; 24/3.6
See application file for complete search history.

(56) References Cited

U.S. PATENT DOCUMENTS 2,131,494 A * 9/1938 Wilson ..... 221/301
3,189,073 A * 6/1965 Todd ..... 224/222
3,651,927 A * 3/1972 Richardson et al. ..... 221/5
4,166,489 A * 9/1979 Lemelson ..... 206/38.1
4,741,434 A * 5/1988 Liebman ..... 206/38
5,127,545 A * 7/1992 French ..... 221/185
5,289,915 A * 3/1994 Queen ..... 206/38
D349,644 S * 8/1994 Miyairi et al. ..... D3/203.2
5,392,975 A * 2/1995 Blankenship, Jr. ..... 224/148.5
5,826,746 A * 10/1998 Ash, Jr. ..... 221/185
5,921,435 A * 7/1999 Billet ..... 221/185
5,956,985 A * 9/1999 Chang ..... 70/456 R
6,321,933 B1 * 11/2001 Vandenberg ..... 221/24
6,471,064 B2 * 10/2002 Gordon ..... 206/534
6,561,379 B1 * 5/2003 Goh ..... 221/90
D483,560 S * 12/2003 Thompson ..... D3/203.2
6,964,361 B2 * 11/2005 Kathrein ..... 224/183
D517,799 S * 3/2006 Oas ..... D3/203.2
7,156,256 B2 * 1/2007 Senda et al. ..... 221/172
D546,056 S * 7/2007 Oas ..... D3/203.2
D562,546 S * 2/2008 Chue et al. ..... D3/203.2
2004/0195260 A1 * 10/2004 Suda et al. ..... 221/210
2005/0205598 A1 * 9/2005 Gelardi ..... 221/263
2007/0170202 A1 * 7/2007 Chen et al. ..... 221/267
2008/0072639 A1 * 3/2008 Kurdziel ..... 70/456 R

* cited by examiner

*Primary Examiner* — Michael K Collins
(74) *Attorney, Agent, or Firm* — Howard B. Rockman

(57) ABSTRACT

An apparatus for storing and dispensing small objects comprises a housing, an interior volume formed in the housing adapted to hold at least one of the small objects, an access port in the housing providing access to the interior volume, and a dispenser closure operatively connected to the housing and movable from a first position closing access to the access port to a second position adapted to provide dispensing of one of the objects from the interior volume through the access port. An openable and closeable attachment loop is integrally formed as part of the housing, the attachment loop adapted to be selectively attached to a holding device to secure the housing to the holding device.

15 Claims, 5 Drawing Sheets

16
40
II
36
38
10
46
22
12
12b
18
34
12a
28
II 14
38
48
24
42
36
18
40
28
46
20
20
20

18
30
28
32
44

18
34
44
32
28
30

36
43
56
38
40
64
24
42
48
68
74
46
62
58
66
72
16
60
14
78
76
80
12b
18
28
42
70
60
14
80'
78'
18
28
12a

COMBINATION CONTAINER AND INTEGRAL ATTACHMENT DEVICE

BACKGROUND

1. Field of the Invention

The invention relates to containers and dispensers of small objects, such as pills, mints, candy, pellet type gum or the like, and particularly to an attachable, portable and easily accessible container and dispenser constructed of plastic or other similar materials.

2. Background of the Invention

In today's society, many people take pills once or several times a day to maintain their health. In addition, many individuals desire to carry mints, mint flavored gum, or other types of breath fresheners with them to keep their breath fresh when in the company of others. Since most people today are constantly moving from place to place, a pill, mint or gum container and dispenser should be available that can be readily carried in one's pocket or purse, or can be securely and removably attached to a person's key ring, belt, purse or briefcase strap, backpack strap or the like. The container and dispenser must also be operable to allow the insertion and removal of pills, mints or gum when necessary, and to hold the pills, mints or gum in the container as the container is transported from place to place. In addition, the container should have an aesthetic design to provide a decorative accessory, and be easy to use and inexpensive to manufacture.

The prior art fails to provide a pill, mint, gum, breath freshener or other article container and dispenser that provides all of the above advantages. U.S. Pat. No. 5,273,177 (the '177 patent) is directed to a case having a press-to-open dispensing closure, and discloses a container having a convex top wall with an aperture and a flexible arcuate surface adjacent the aperture. The top surface is selectively movable between concave and convex positions. A flexible aperture cover is also connected to the top surface by a hinge structure. The cover is closed when the top surface is in the convex position and open when the top surface is in the concave position. The '177 patent does not disclose a container and dispenser that has a loop portion integrally formed as part of the container and dispenser, that enables convenient carrying by removably and securely attaching the container to holding devices such as key rings, purses and backpacks.

U.S. Pat. No. 6,763,945 (the '945 patent) is directed to a dispenser for storing and dispensing small objects, and a method of dispensing small objects with the dispenser, and discloses a dispenser housing with a dispensing aperture and a closure mechanism. The closure mechanism includes a button portion, a flap portion, a fulcrum extending into the interior volume of the dispenser and a portion secured to the dispenser housing. To open the dispensing aperture, a user presses the button portion causing the closure to bend and the flap to make contact with the interior fulcrum, causing the free end of the flap portion to move away from the housing and uncover the aperture. The user can then close the dispenser by applying pressure to the open flap to displace the flap portion towards the housing and the aperture. The '945 patent does not disclose a container and dispenser that has a loop portion integrally formed as part of the container and dispenser, that enables convenient carrying by removably and securely attaching the container to holding devices such as key rings, purses and backpacks.

U.S. published patent application No. 2005/0155873 discloses a thin plastic dispenser, of generally rectangular shape, for discharging toothpicks and/or mints through distinct discharge passages in the dispenser. The reference also discloses locking levers on the dispenser that can seal the discharge passages or alternatively open the passages to allow mints or toothpicks to be dispensed from the dispenser. However, the reference does not disclose a container and dispenser that has a loop portion integrally formed as part of the container and dispenser, that enables convenient carrying by removably and securely attaching the container to holding devices such as key rings, belts, purses and backpacks, nor does it disclose a container and dispenser having an oval-like shape.

US pending patent application No. 2004/0094567 discloses a tablet dispenser comprising a container body, a storage region, a dispensing outlet, and a passage between the storage region and the dispensing outlet. The reference further discloses a valve member and a stop member. The valve member is disposed between the storage region and the dispensing outlet, and movable between an open and closed position. The stop member is spaced from the valve to define a passage of a size to accommodate an item to be dispensed, and movable into and out of a closed position in which the stop member prevents release of an item to be dispensed through the passage. However, the reference does not disclose a container and dispenser that has a loop portion integrally formed as part of the container and dispenser, that enables convenient carrying by removably and securely attaching the container to holding devices such as key rings, belts, purses and backpacks.

It is evident that none of the prior art in the related field shows a container and dispenser having both a loop portion integrally formed as part of the aesthetics of the container and dispenser, enabling convenient carrying by attaching the container to a key chain or key ring, a belt or a backpack, and a dispensing door which provides easy access to objects held inside the container and dispenser.

Thus, it is a primary object of this invention to provide a container and dispenser that achieves the goals of easy accessibility of items such as pills, mints, gum and the like, and portability.

SUMMARY OF THE INVENTION

The present invention is directed to a container and dispenser for storing and dispensing small objects such as candy, pills, tablets, mints, gum, breath fresheners, etc. The illustrated embodiments of the invention have an oval-like or elongated rectangular shape, but other shapes can also be adopted.

The container and dispenser includes a housing having an interior volume for storing small objects and a dispenser closure having a door member for dispensing small objects when in a dispensing position. The door also allows the small objects to be inserted into the container for filling purposes. A loop portion is provided integral with the container, the loop having an overlapping opening which enables attachment of the container and dispenser to a key ring or chain, a backpack, a purse strap, a belt or the like. The door member can be a panel door on a living hinge which swings outward to allow access to small objects inside the interior volume, or a pivoting door where pushing down on one side of the door allows the other side of the door to pivot upward, delivering one of the small objects inside the container to a user of the container.

DETAILED DESCRIPTION OF THE ILLUSTRATED EMBODIMENTS

Figure 1:
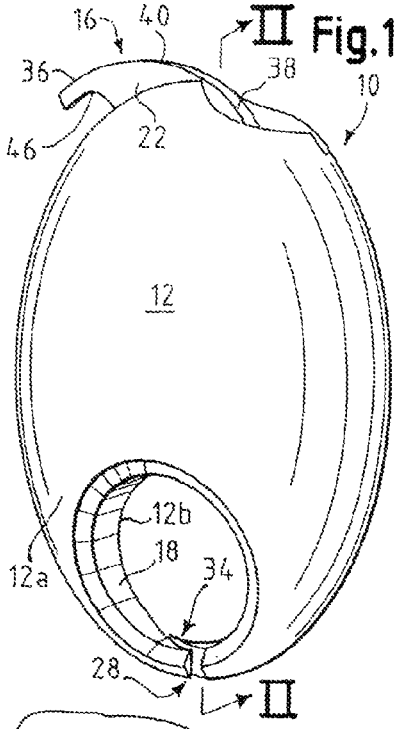
FIG. 1 is a front perspective view of an embodiment of a container and dispenser in accordance with the present invention, with the dispenser closure shown in a dispensing position.

As seen in FIGS. 1-5, the container and dispenser 10 of the first embodiment of the present invention generally comprises a housing 12 having an interior volume 14, a dispenser closure 16 and an attachment loop 18.

Housing 12 may be formed as a single piece by molding, or by attaching two side portions 12*a* and 12*b*, which are molded separately by any suitable means known in the art. Typically, side portions 12*a* and 12*b* can be attached together using heat bonding or the like, or by mechanical means such as mating flanges and sockets.

Figure 2:
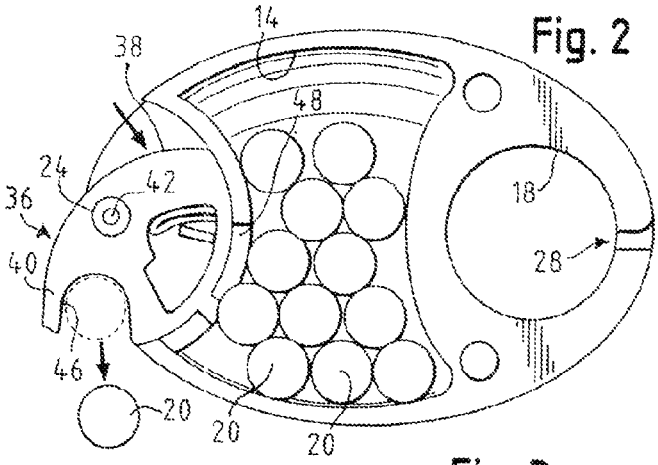
FIG. 2 is a cross sectional view of the container and dispenser of FIG. 1, taken along line II-II of FIG. 1, showing small items in the container.
Figure 5:
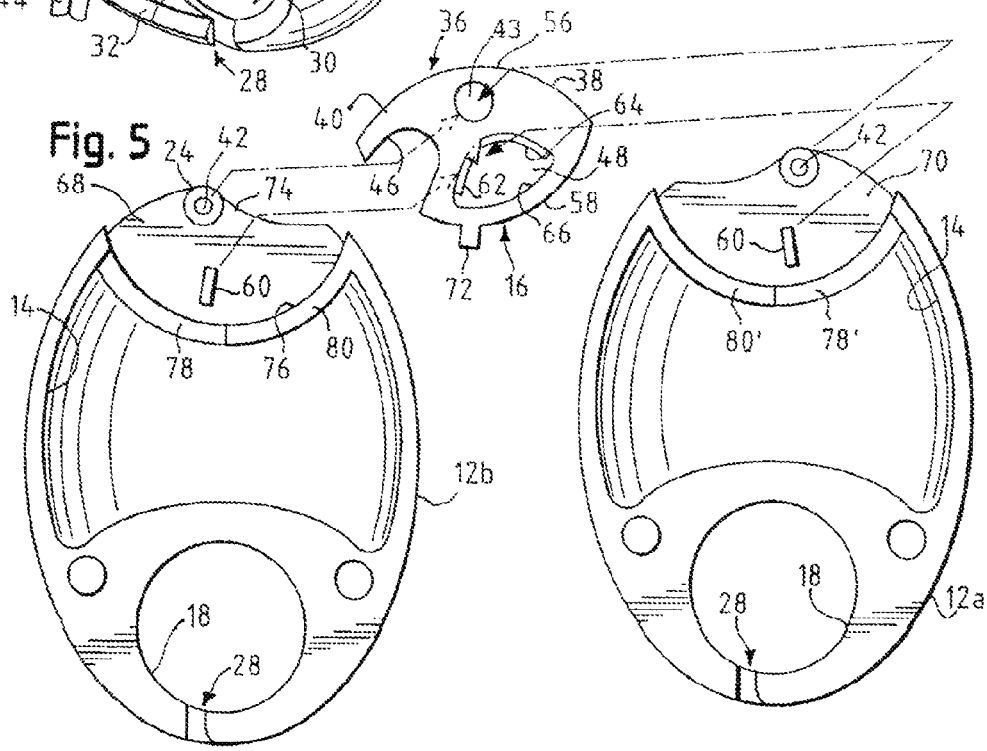
FIG. 5 is a an exploded plan view of the two halves of the container and dispenser of FIG. 1, showing the interior side of both housing halves and the pivoted dispenser closure in its closed position.

Interior volume 14 is adapted to hold one or more small objects 20 such as candy, pills, tablets, mints, or anything else that can be stored and dispensed using container and dispenser 10 in a similar way. Dispenser closure 16 comprises a dispenser door assembly 22 including a pivoting dispenser door 36, and an access port or cavity 46 formed in dispenser door 36. As seen in FIG. 2 and FIG. 5, access port 46 is an irregularly shaped cavity in dispenser door 36, the cavity 46 communicating with the interior volume 14 of the container 10 when the door 36 is closed. Before dispensing, at least one small object 20 is moved to cavity 46 from interior volume 14, such as by inventing the container 10 and moving the small objects 20 to the top of the container 10 under the force of gravity.

In the embodiment of the present invention shown in FIGS. 1-5, pivoting dispenser door 36 of door assembly 22 has a first end 38 and a second end 40, a first side member 68, a second side member 70 and a stop member 60. Dispenser door 36 is pivotally mounted to housing 12 through aperture 24 of dispenser door 36, and the door pivotally rotates through an arc around shaft 42 between a closed position (FIG. 5) to an open or dispensing position (FIGS. 1, 2). Normally, pivoting dispenser door 36 is in a closed position (FIG. 5) so that small objects 20 are securely kept inside volume 14 of housing 12. In the dispensing position, where first end 38 of pivoting dispenser door 36 is pushed down, dispenser door 36 pivots on shaft 42, and second end 40 pivots upward. The closure 16 is now in position to dispense one of the small objects 20 from interior volume 14 through access port 46, as illustrated in FIG. 2.

Referring to FIG. 5, first side member 68 and second side member 70 of door assembly 22 are integrally formed as part of housing side portions 12*b* and 12*a*, respectively, wherein second side member 70 is a mirror image of first side member 68. First side member 68 comprises a curved top 74 and an arcuate bottom 76, the latter having a first portion 78 and a second portion 80. First portion 78 of bottom 76 is carved out or hollow, providing a space for small objects 20 to enter access port 46 from interior volume 14, while second portion 80 is a separating wall that keeps small objects 20 inside interior volume 14 from entering other parts of dispenser closure 16. Stop member 60 is associated with both side members 68, 70 by molding or attachment. Shaft 42 is mounted to both side members 68, 70 near the top and passes through aperture 24 of pivoting dispenser door 36, allowing dispenser door 36 to pivotally rotate around shaft 42.

The contour of pivoting dispenser door 36, as illustrated in FIG. 5, comprises an arcuate top side 56, a bottom side 58, a pivoting center 43 and an aperture 48. A stop member 72 is integrally formed as part of and extends outward from bottom side 58. Part of bottom side 58 is carved out to form access port 46, while the rest remains arcuate in shape, as illustrated in FIG. 5. Aperture 48 has a first side stop member 62, a second side stop member 64 and a third side member 66, each side member having a curved shape. First and second side stop members 62, 64 can be supplied with cushion material. When dispensing a small object 20, end 38 of pivoting dispenser door 36 is pushed down and rotated about shaft 42 by the user, and dispenser door 36 pivots on its center 42 until side stop member 64 of aperture 48 abuts stop member 60 of door assembly 22, thus preventing dispenser door 36 from further rotation in housing 12. Stop member 72 also acts as a stopper to keep dispenser door 36 from sliding out of housing 12 when dispenser door 36 is pivotally rotated.

Figure 3:
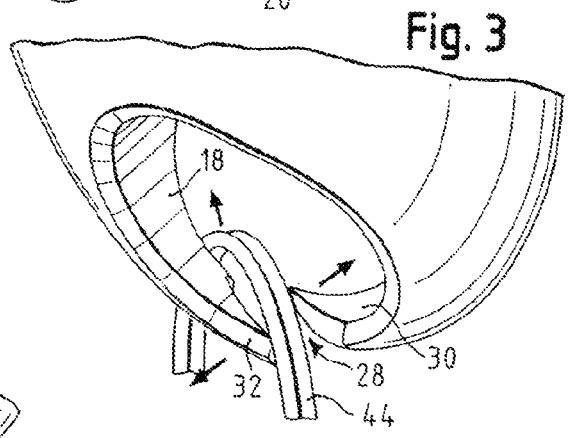
FIG. 3 is a front detail perspective view of the container and dispenser of FIG. 1, with the attachment loop shown in an open position and a key ring being inserted into the opening of the attachment loop.
Figure 4:
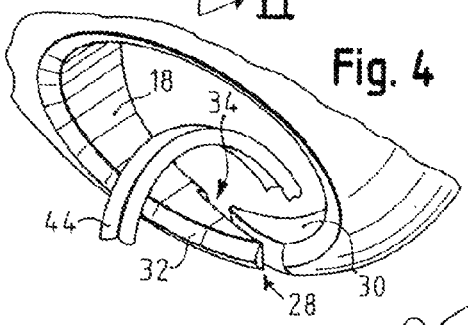
FIG. 4 is a front detail perspective view of the container and dispenser of FIG. 1, with the attachment loop shown in a closed position and the key ring fully inserted into the attachment loop.

As best seen in FIGS. 1, 3 and 4, attachment loop 18 includes an overlapping member 28, the overlapping member 28 having a first overlapping portion 30 and a second overlapping portion 32 forming a detachable overlapping closure 34. By expanding first overlapping portion 30 in a direction away from second overlapping portion 32, attachment loop 18 can be removably attached to a key ring 44, a backpack strap, belt or other like holding device. The overlapping portions 30, 32 are integrally molded as part of housing side portions 12*a*, 12*b*, respectively.

Another embodiment of the present invention is shown in FIGS. 6-11, where like elements and features shown in FIGS. 1-5 have the same numerical designations as in FIGS. 1-5. Referencing to FIGS. 6-11, dispenser closure 16 comprises a swing door 52, said swing door attached through a living hinge 54 or other suitable attachment means to housing 12. Swing door 52 pivotally rotates through an arc around living hinge 54 between a closed position (FIG. 6) to an open or dispensing position (FIG. 9), the latter position providing an opening to access port 46, said access port 46 being an aperture opening in housing 12 (FIGS. 10 and 11) when swing door 52 is in an open or dispensing position.

Normally, swing door 52 is in a closed position (FIG. 6) so that small objects 20 are securely kept inside volume 14 of housing 12. Swing door 52 is swung out to an open or dispensing position (FIG. 9) by pivoting swing door 52 outward around living hinge 54, wherein access to small objects 20 in interior volume 14 is provided at access port 46. After a small object 20 has been removed at access port 46 (FIGS. 10 and 11), door 52 is pivoted back to its closed position (FIG. 6) when the door 52 snaps to its closed position, as is known in the art, through a snap fit connection with housing 12.

Figure 6:
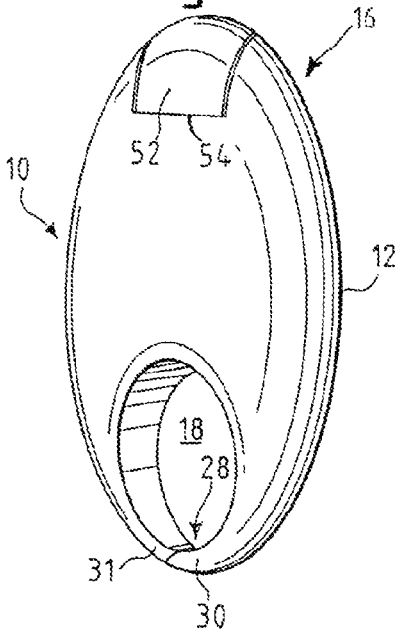
FIG. 6 is a front perspective view of another embodiment of the container and dispenser of the present invention, with the dispenser closure shown in a closed position.
Figure 9:
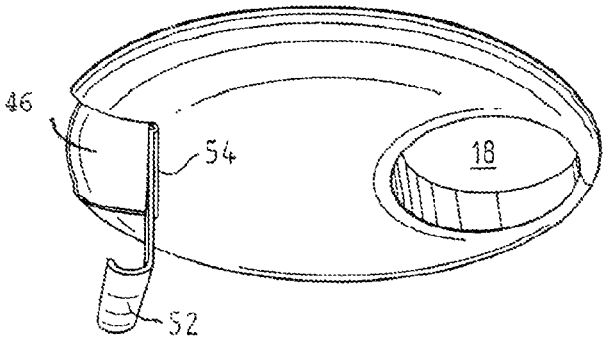
FIG. 9 is a front perspective view of the container and dispenser of FIG. 6, with the dispenser closure shown in an open or dispensing position.
Figure 10:
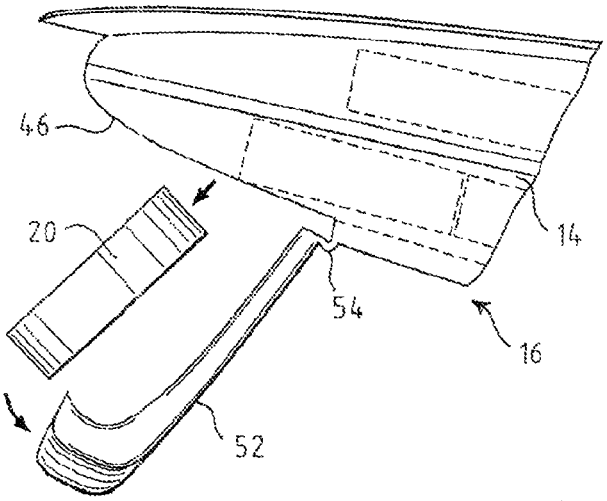
FIG. 10 is a detail side view of the container and dispenser of FIG. 6, with the dispenser closure shown in a dispensing position in the process of dispensing a small object from the container.
Figure 7:
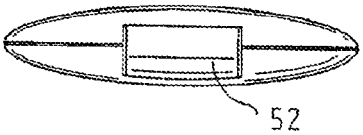
FIG. 7 is a top elevation view of the container and dispenser of FIG. 6.
Figure 8:
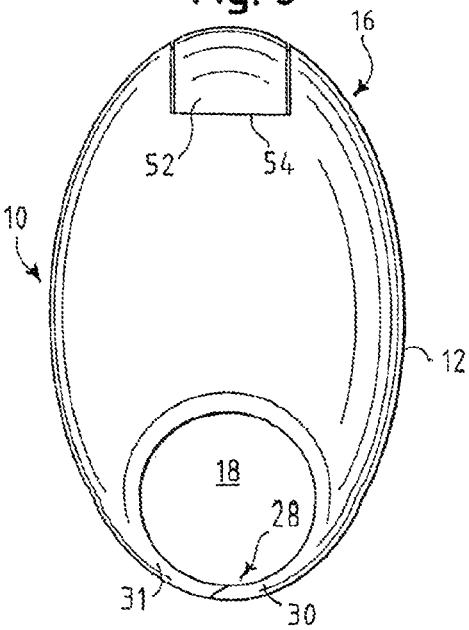
FIG. 8 is a front plan view of the container and dispenser of FIG. 6.
Figure 11:
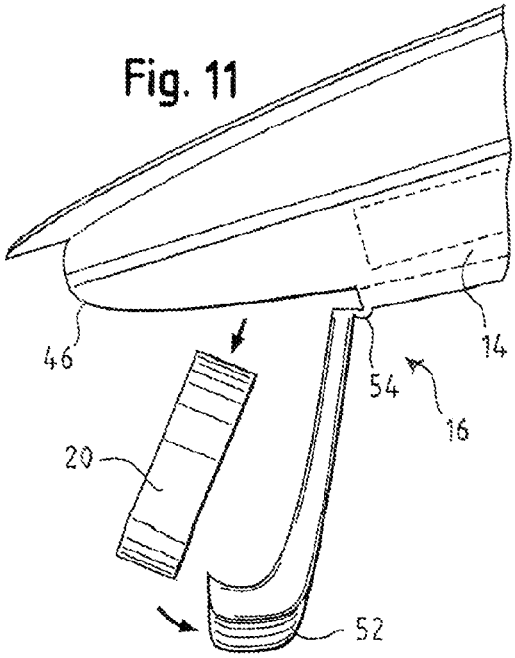
FIG. 11 is another detail close-up view of the container and dispenser of FIG. 6, with the dispenser closure shown in a dispensing position after completing dispensing a small object.

In the embodiment of FIGS. 6-1, attachment loop 18 includes an overlapping access member 28, the overlapping member 28 having a first overlapping portion 30 and a second overlapping portion 32 forming a detachable overlapping closure 34. By expanding first overlapping portion 30 in a direction away from second overlapping portion 32, attachment loop 18 can be removably attached to a key ring chain 44, a backpack strap, a belt or other like holding device, as shown in FIGS. 6 and 8. Each overlapping portion 30, 32 is integrally molded with a respective housing side portion 12*a*, 12*b*.

Container and dispenser 10 may be made of any appropriate materials, such as translucent or opaque plastic. To allow viewing of small objects 20 from outside interior volume 14, housing 12 may be made of a transparent material such as clear plastic.

In the illustrated embodiments of FIGS. 1-11, the housing has a generally oval shape. However, different shapes or configurations may be adopted for different applications.

Figure 12:
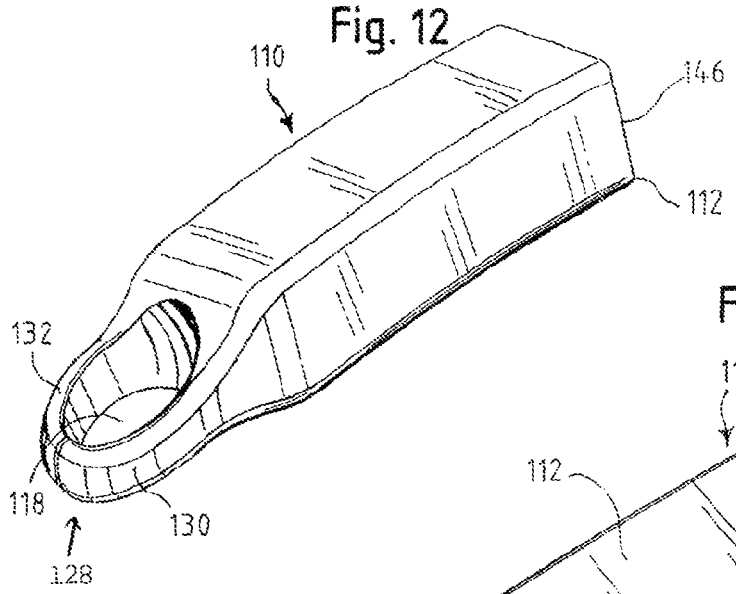
FIG. 12 is a perspective view of a further embodiment of the container and dispenser of the present invention, shown without the dispenser closure.

A further embodiment of the present invention is illustrated in FIGS. 12-22. In this embodiment, the housing 112 of the dispenser 110 has an elongated rectangular shape. As seen in FIG. 12, the housing 112 may be formed as a single molded piece. Alternatively, the housing 112 may be formed by suitably attaching a cover portion 112*a* and a bottom portion 112*b*, which are molded separately by suitable means known in the art. (FIG. 13) Typically, cover portion 112*a* and bottom portion 112*b* can be attached using heat bonding or the like, or by mechanical means such as mating flanges and sockets. In this embodiment, the top 112*a* and bottom portion 112*b* are connected by a flange 113 (FIG. 16) extending outwardly from a surface 115 defining a groove 117, as shown in FIGS. 16-20.

Figure 15:
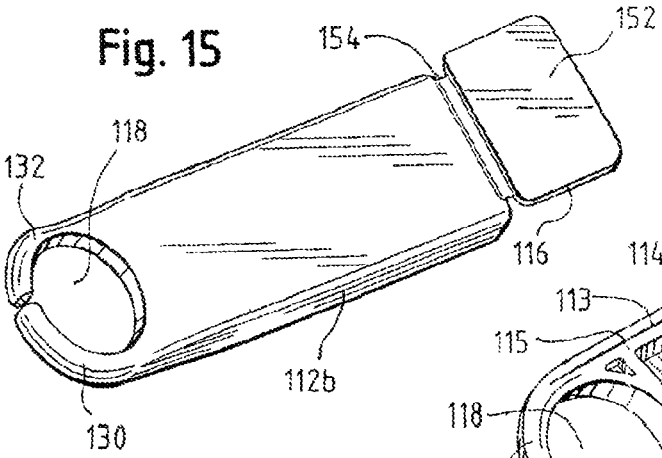
FIG. 15 is a perspective view of the underside of the bottom portion of the container and dispenser shown in FIG. 13 with the dispenser closure in the open position.
Figure 16:
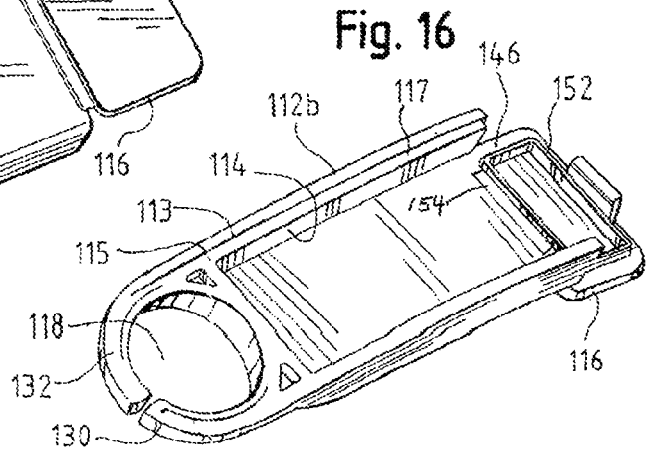
FIG. 16 is a perspective view of the opposite side of the bottom portion of the container and dispenser shown in FIG. 15.
Figure 17:
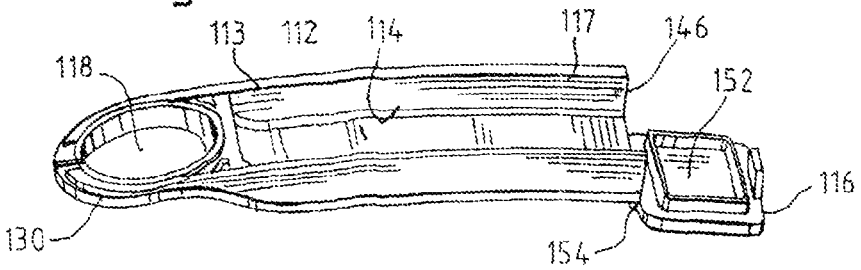
FIG. 17 is a perspective view of the bottom portion of the container and dispenser shown in FIG. 16.
Figure 19:
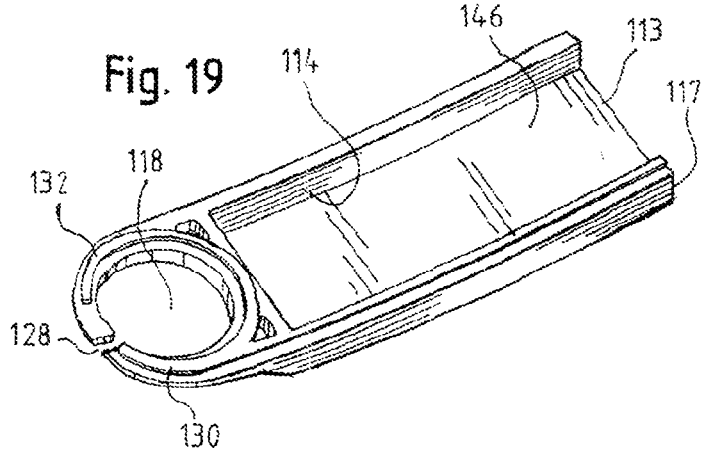
FIG. 19 is a perspective view of the opposite side of the top portion of the container and dispenser shown in FIG. 18.

Interior volume 114 of dispenser 110 is adapted to hold one or more small objects such as candy, pills, tablets, mints, pellet style gum, or anything else that can be stored and dispensed using the container and dispenser 110 in a similar way. FIGS. 15-17 further illustrate the dispenser closure 116 which comprises a swing door assembly 152 and an access port or cavity 146.

Figure 13:
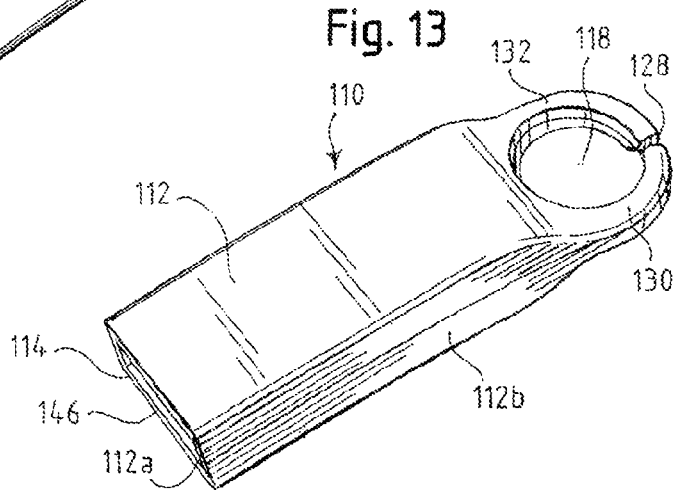
FIG. 13 is an opposite side perspective view of the embodiment of the container and dispenser shown in FIG. 12, also shown without the dispenser closure.
Figure 14:
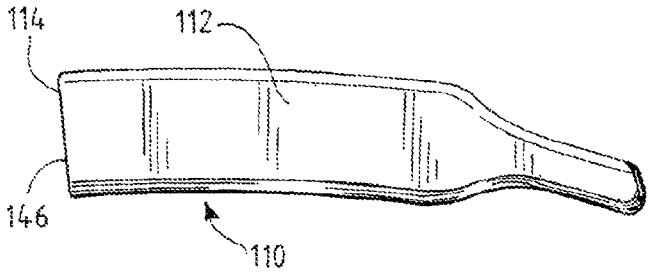
FIG. 14 is a side view of the embodiment of the container and dispenser shown in FIG. 12.
Figure 22:
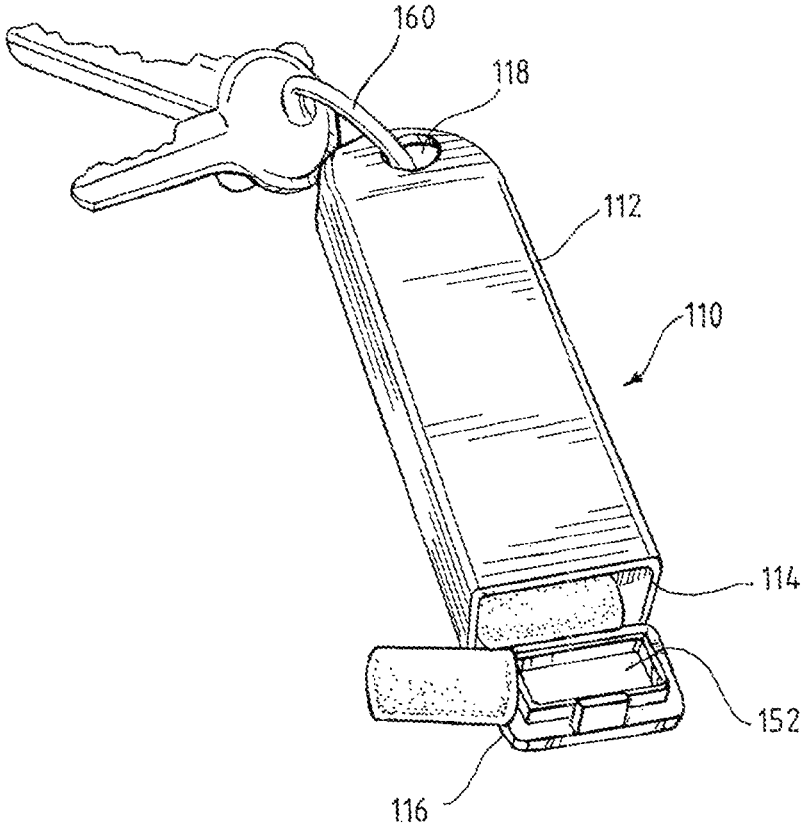
FIG. 22 is a front perspective view of the container and dispenser of FIG. 12 showing small items in the container, with the dispenser closure in the open position and a key ring fully inserted into the attachment loop.

As best seen in FIGS. 12 and 13, attachment loop 118 includes an extension member 128, the extension member 128 having a first overlapping portion 130 and a second overlapping portion 132 forming a detachable closure 134. By expanding first portion 130 in a direction away from second portion 132, attachment loop 118 can be removably attached to a key ring, a backpack strap, belt or other like holding device. FIG. 22 shows a key ring 160 fully inserted in the attachment loop 118 of the dispenser 110.

Referencing FIGS. 15-17 and 21-22, the dispenser closure 116 comprises a swing door 152, said swing door attached through a living hinge 154 or other suitable attachment means to housing 112. Swing door 152 pivotally rotates through an arc around living hinge 154 between a closed position (FIG. 21) to an open or dispensing position (FIGS. 15-17 and 22), the latter position providing an opening to access port 146. Access port 146 is formed by access part 146 in housing 112 when the swing door 152 is in an open or dispensing position.

Figure 18:
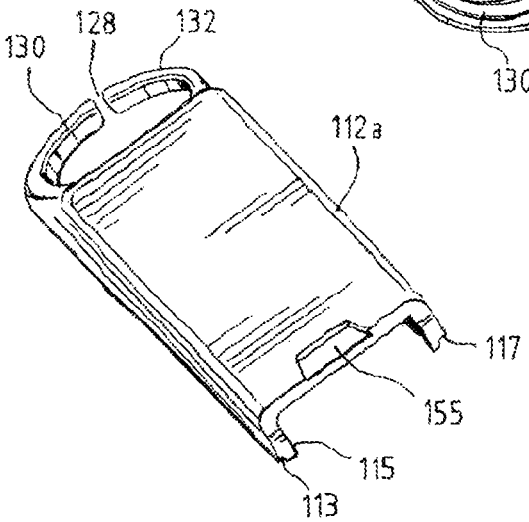
FIG. 18 is a perspective view of the front side of the top portion of the container and dispenser shown in FIG. 13.
Figure 21:
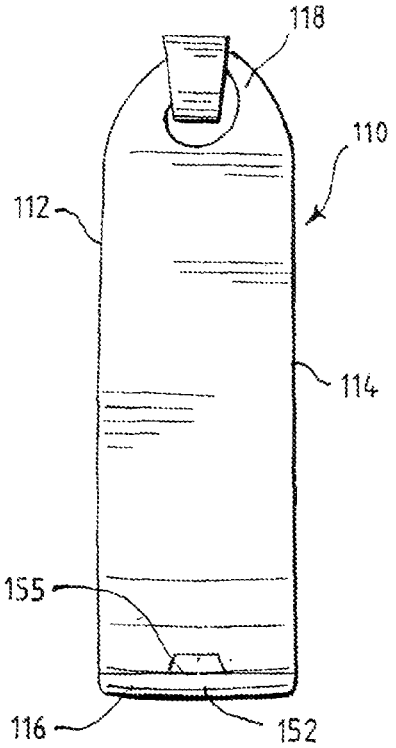
FIG. 21 is a front view of the container and dispenser of FIG. 12 with the dispenser closure in the closed position.
Figure 20:
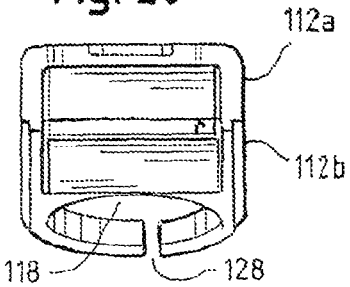
FIG. 20 is an end assembly view of the container and dispenser of FIG. 12, showing the bottom and top portion of the dispenser connected together to form a dispenser housing.

Normally, swing door 152 is in a closed position (FIG. 21) so that small objects are securely kept inside volume 114 of housing 112. Swing door 152 is swung out to an open or dispensing position (FIGS. 15-17 and 22) by pivoting swing door 152 outward around living hinge 154, wherein access to small objects in interior volume 114 is provided at access port 146. After a small object has been removed at access port 146 (FIG. 22), door 152 is pivoted back to its closed position (FIG. 21) where the door 152 snaps to its closed position, as is known in the art, through a latch and groove connection 155 with the housing 112. (FIG. 18)

Similar to prior illustrated embodiments, container and dispenser 110 may be made of any appropriate materials, such as translucent or opaque plastic. To allow viewing of small objects from outside interior volume 114, housing 112 may be made of a transparent material such as clear plastic.

The invention is not limited by the embodiments disclosed herein and it will be appreciated that numerous modifications and embodiments may be devised by those skilled in the art. Therefore, it is intended that the following claims cover all such embodiments and modifications that fall within the true spirit and scope of the present invention.

What is claimed is:

1. An apparatus for storing and dispensing a plurality of small objects, comprising:

a. an integrally formed housing;

b. an interior volume formed within said housing, said interior volume adapted to hold at least one of said plurality of small objects in said housing;

c. an access port in said housing providing access to said interior volume, said access port including an opening into said interior volume;

d. a dispenser closure operatively connected to said housing, said dispenser closure movable from a first position closing access to said access port to a second position opening access to said access port and said dispenser closure adapted to dispense at least one of said plurality of small objects from said interior volume through said access port, said interior volume remaining the same when said dispenser closure is moved from said first position to said second position;

e. said dispenser closure has a first and a second end, whereby applying a force to said first end allows upwardly pivotal movement of said dispenser closure to said second position to provide said dispensing through said access port;

f. an openable and closeable attachment loop comprised of two overlapping extensions, each said overlapping extension injection molded as an integral part of and in the same plane as said housing, said overlapping extensions adapted to be selectively opened and closed, said attachment loop adapted to attach to a holding device when opened to secure the housing to the holding device, said holding device being other than said housing.

2. The apparatus of claim 1, wherein said housing has an oval shape, said attachment loop formed within the oval shape of said housing.

3. The apparatus of claim 1, wherein said apparatus is made of one of translucent and opaque materials.

4. The apparatus of claim 1, wherein said holding device is one of a key ring, a backpack, and a belt.

5. The apparatus of claim 1, wherein said dispenser closure comprises a swing door, said swing door attached to said housing through a living hinge mechanism integral to both said housing and said closure.

6. The apparatus of claim 5, wherein said swing door rotates around said hinge between said first closed position and said second dispensing position, said second dispensing position providing an opening allowing access to said objects in said interior volume.

7. The apparatus of claim 6, wherein said swing door snaps from said second dispensing position back to said first closed position through a snap fit connection with said housing.

8. The apparatus of claim 1, wherein the housing comprises a top portion and a bottom portion connected together to form the interior volume in the housing, said top portion and bottom portion extending parallel to a longitudinal central axis of the housing, the interior volume formed from a cavity formed in both said top portion and said bottom portion.

9. The apparatus of claim 1, wherein the housing has a generally rectangular elongated shape.

10. The apparatus of claim 8, wherein the top portion and the bottom portion are connected by a flange extending outwardly from a surface defining a groove and extending along a length of each side of the top and bottom portion.

11. The apparatus of claim 6, wherein said swing door snaps from said second dispensing position back to said first closed position through a latch connection with the housing.

12. An apparatus for storing and dispensing small objects, comprising:

a. an integrally formed housing;

b. an interior volume formed within said housing, said interior volume adapted to hold at least one of said small objects in said housing;

c. an access port in said housing providing access to said interior volume, said access port including an opening into said interior volume;

d. a dispenser closure operatively connected to said housing, said dispenser closure movable from a first position closing access to said access port to a second position adapted to provide dispensing of at least one of said objects from said interior volume through said access port;

e. said dispenser closure has a first and a second end, whereby applying a force to said first end allows upwardly pivotal movement of said dispenser closure to said second position to provide said dispensing through said access port;

f. an openable and closeable attachment loop comprised of two overlapping extensions, each said overlapping extension injection molded as an integral part of and in the same plane as said housing, said overlapping extensions adapted to be selectively opened and closed and said attachment loop adapted to be attached to a holding device to secure the housing to the holding device, said holding device being other than said housing;

g. wherein said attachment loop includes a first portion and a second portion that open and close relative to each other, forming a detachable overlapping closure.

13. The apparatus of claim 12, wherein said first portion and said second portion of said attachment loop are integrally formed with said housing.

14. An apparatus for storing and dispensing small objects, comprising:

a. an integrally formed housing;

b. an interior volume formed in said housing, said interior volume adapted to hold at least one of said small objects in said housing;

c. an access port in said housing providing access to said interior volume;

d. a dispenser closure operatively connected to said housing, said dispenser closure movable from a first position closing access to said access port to a second position adapted to provide dispensing of at least one of said objects from said interior volume through said access port and said dispenser closure closing access to said interior volume when in said first position and when in said second position;

e. an openable and closeable attachment loop comprised of two overlapping arms, each said overlapping arm injection molded as an integral part of and in the same plane as said housing, said attachment loop adapted to be selectively opened and closed and attached to a holding device when opened to secure the housing to the holding device, said holding device being other than said housing;

f. said dispenser closure has a first and a second end, whereby applying a force to said first end allows upwardly pivotal movement of said second end to said second position to provide said dispensing through said access port;

g. said access port comprises a cavity in said dispenser closure, said cavity communicating with said interior volume when said dispenser closure is in said first position and closes access to said cavity;

h. said dispenser closure is pivotally mounted to said housing; and i. said apparatus includes a stopping mechanism, said stopping mechanism comprising a first stop member integral to and internally located in an aperture located in said dispenser closure, and a second stop member integral to and internally located in said housing, said second stop member extending into said aperture formed in said dispenser closure, wherein pivotal movement of said dispenser closure is terminated when said first stop member abuts said second stop member.

15. The apparatus of claim 14, wherein the two overlapping arms are adapted to be selectively opened and closed.

* * * * *